United States Patent [19]

Ezell

[11] 4,307,470

[45] Dec. 29, 1981

[54] JAC PAC

[76] Inventor: Sandra L. Ezell, P.O. Box 1285, Paso Robles, Calif. 93446

[21] Appl. No.: 142,475

[22] Filed: Apr. 21, 1980

[51] Int. Cl.[3] ..... A41D 1/02; A41D 3/02

[52] U.S. Cl. ..... 2/108; 2/85

[58] Field of Search ..... 2/108, 84, 85, 87, 88

[56] References Cited

U.S. PATENT DOCUMENTS

| | | | |
|---|---|---|---|
| 2,971,198 | 2/1961 | Tomich | 2/88 |
| 4,060,853 | 12/1977 | Gabarro | 2/108 |
| 4,078,264 | 3/1978 | De Gennaro | 2/88 |

*Primary Examiner*—Doris L. Troutman

[57] ABSTRACT

The Jac Pac is a jacket or a backpack, two separate articles of clothing formed from one which cannot be used as both at the same time. The Jac Pac may be used as a jacket for warmth or may be removed and formed into a backpack for carrying objects.

2 Claims, 8 Drawing Figures

JAC PAC

This invention relates generally to garments.

The Jac Pac is a jacket or a backpack designed for use by cyclists, schoolchildren, skiers, joggers, and anyone interested in outdoor type activities.

One object of the Jac Pac is to provide the warmth of a jacket in the early morning hours when some activities begin and then to provide a suitable means for carrying objects such as schoolbooks, etc., in the warmth of the afternoon.

Yet another object of the Jac Pac is to begin it's daily use as a backpack to carry objects such as lunch for a cyclist or jogger and then to turn into and provide the warmth of a jacket if desirable in the later hours of the day.

Other objects of the Jac Pac are to provide the convenience of both a backpack and jacket in one single article of clothing which should be inexpensive to manufacture costing not much more than a conventional jacket of the same general design.

These and other objects will be readily evident upon a study of the following specification and the accompanying drawings.

Wherein:

FIG. 1 is a front view of the Jac Pac in jacket form. It appears as a totally conventional jacket front that may or may not include pockets.

FIG. 2 is a view of the Jac Pac back (in the form of a jacket). It appears generally conventional in design except for material lapping running parallel from the shoulder seams to the bottom hem on either side of the back. Also showing straps connected within the shoulder seams and running parallel to the lapping and connected at the middle back with "D" rings.

FIG. 3 is a view of the Jac Pac (in the form of a jacket) as in FIG. 2 except that the material lapping has been omitted to show zipper placement. The two separable zippers have been placed with one half running up the back from the middle of Jac Pac and it's mate running down the back from the same general starting point. One zipper on either side of Jac Pac.

Figure 1:
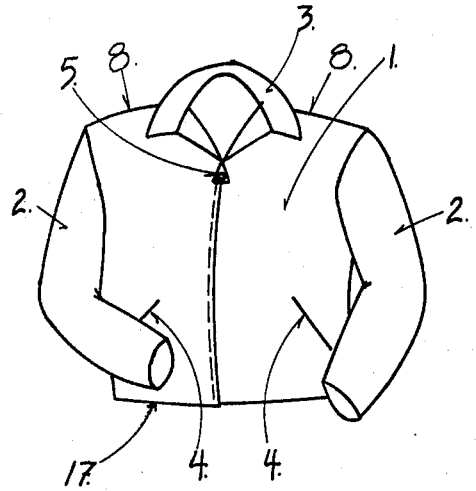

The jacket front 1 (FIG. 1) is totally conventional with no special features and can be styled or decorated according to any current fashion design. It has, of course, the conventional sleeves 2 and collar 3 styled in whatever design desirable for a current fashion look. The jacket front 1 may or may not have pockets 4. The pockets 4 I have shown are conventional jacket or windbreaker pockets but may be styled in any suitable design. The jacket front 1 is closed, preferably, with a separating zipper 5 or by any suitable means of closure.

Figure 2:
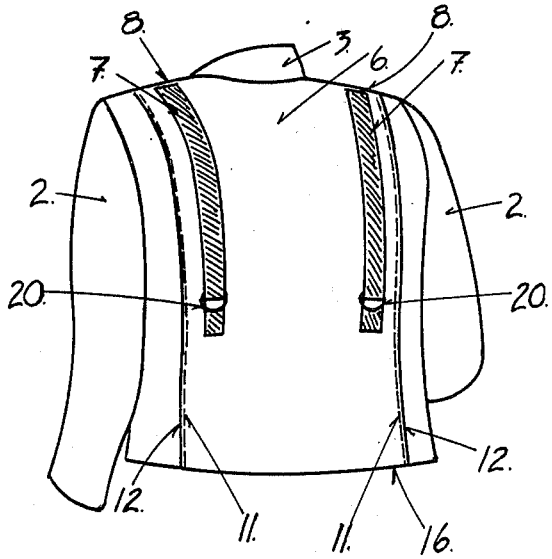
Figure 3:
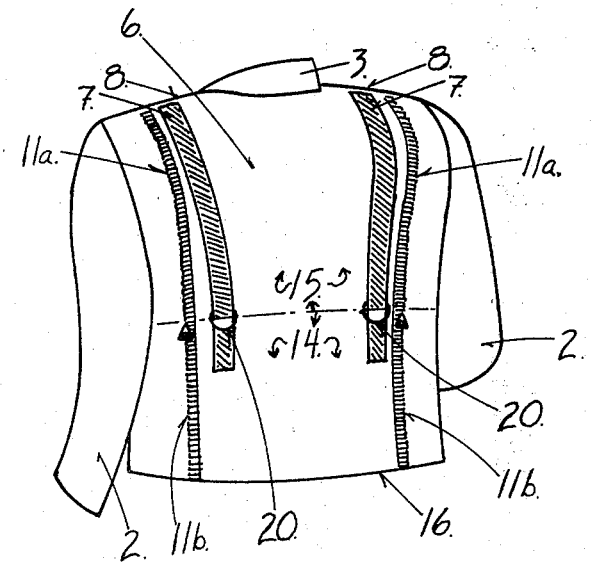

The jacket back 6 (FIG. 2) is generally conventional, but is provided with a pair of vertical, parallel straps 7 secured at the shoulders 8 within the regular shoulder seam and extending to middle back of the jacket and adjusted onto "D" rings 20 or any other suitable means for creating an adjustable situation; and a pair of vertical, parallel zipper tracks 11, preferably, covered by lapping material 12. When worn as a jacket, the zipper tracks 11 extend individually downwardly from the shoulders 8 adjacent to the corresponding outer edges of the back 6. Each zipper 11 (FIG. 3) is of the separable type and the upper track 11*a* mates with it's lower track 11*b* when the lower half of the garment is folded up into backpack form. The straps 7 are disposed inwardly of and adjacent to the zipper tracks 11 when the Jac Pac is worn as a jacket.

Figure 4:
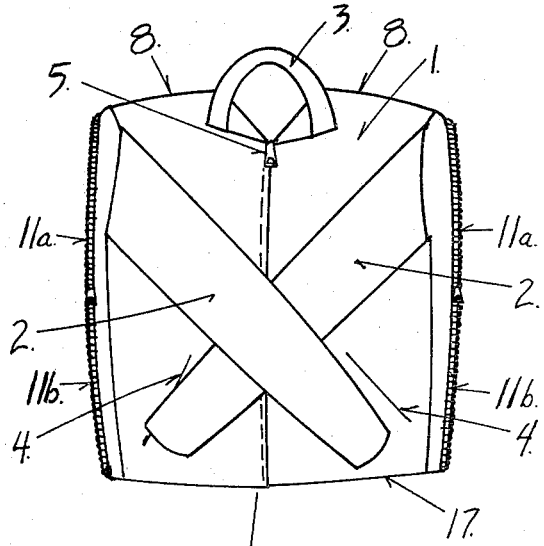
FIG. 4 is a view of the beginning of the folding process. The sleeves are folded forward across the front of Jac Pac (the jacket front zipper being in the closed position) therefore bringing the back zippers to the outer edges of the now folded Jac Pac.
Figure 5:
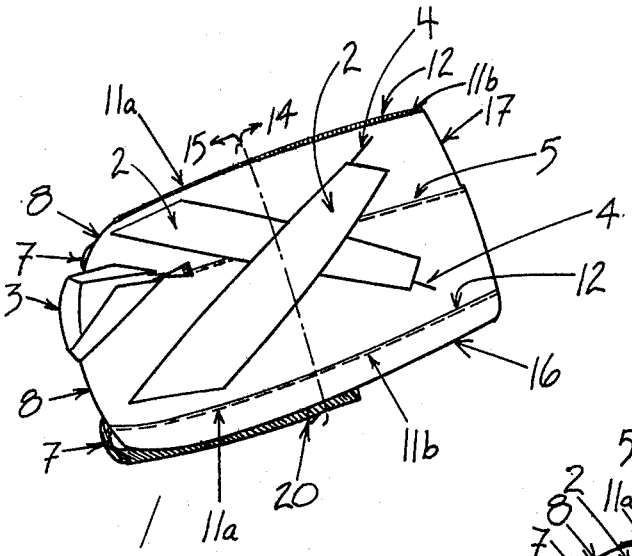
FIG. 5 is a side view of the Jac Pac being folded bottom hem to shoulder seams, bringing the back zippers into juxtaposition with their respective mates.
Figure 6:
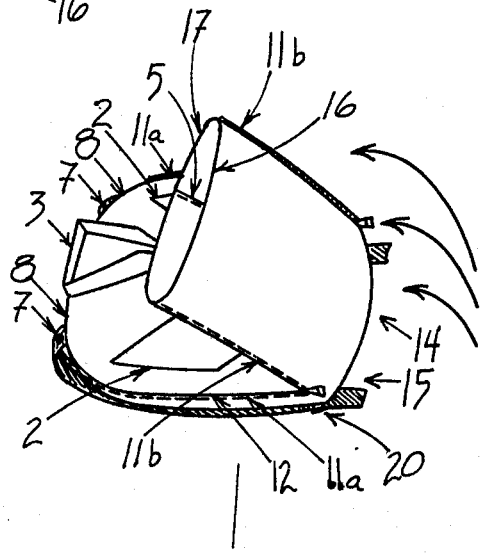
FIG. 6 is a side view not unlike FIG. 5 only showing a more advanced view of the bottom hem to shoulder seams fold.
Figure 7:
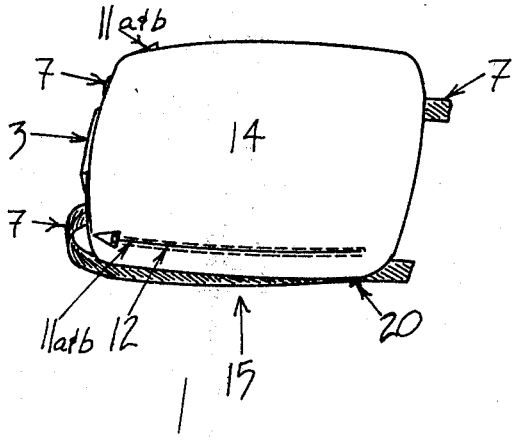
FIG. 7 is a side view of the Jac Pac with the zippers now in the closed position and the material lapping covering and hiding them from view. The garment is now in the backpack state and the straps can be adjusted on the "D" rings to fit over the wearers shoulders.
Figure 8:
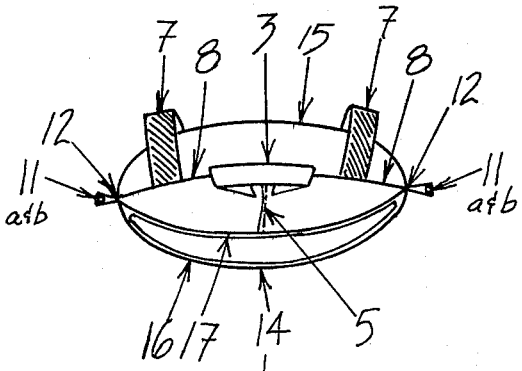
FIG. 8 is a top view of the now folded and zipped Jac Pac (in the form of a backpack) and indicates the spaces provided to carry packages or individual items.

To convert the garment into a backpack (FIGS. 4 & 5) the sleeves 2 are first folded forwardly and crossed in front of the jacket front 1 (the jacket front zipper 5 is in the closed position). The folding forward of the sleeves 2 brings the zipper tracks 11 around to the sides of the jacket so that they now run vertical along each side of the jacket; and the straps 7 remain on the back 6. The lower half 14 of the garment is then folded upwardly, bringing the mating halves of the zipper tracks 11*a* and 11*b* together. The zippers 11 (FIG. 7) are then closed, retaining the garment in it's folded disposition for the purpose of securing the jacket into a useable, servicable backpack with space created (FIG. 8) between the folded top 15 and bottom 14 and between the lower back hem 16 and lower front hem 17 for the purpose of carrying items.

The straps 7, meanwhile, have remained exposed on the back 6 and can be adjusted on "D" rings 10 or any suitable means of adjustment to be worn over the shoulders in the fashion of a normal backpack.

Having described the Jac Pak I therefore claim:

1. A jacket constructed a. of any type of material, lightweight or heavy, water repellant or not b. with a conventional front with a separable zipper from neckline to hemline center front c. and with the back specialized with a pair of vertical parallel separable zipper tracks, each zipper separated and one-half of each separated zipper track attached individually into shoulder seam two inches from sleeve seam; said separated one-half of zipper track extending downwardly from shoulder seam to waistline, and the second one-half of separated zipper track attached two inches below waistline and extended downwardly to hemline;

d. and each pair of attached separated zippers are covered by material lapping;

e. and a pair of vertical parallel straps secured within the regular shoulder seam and placed one inch from each zipper track toward center back, and secured at waistline by "D" rings or any other suitable means for creating an adjustable situation;

f. and this jacket having the ability to fold into a secured backpack.

2. A backpack a. formed from and including within its folds a complete jacket constructed as claimed in claim 1, and b. converted into a backpack by closing front center zipper track from hemline to neck opening, folding sleeves forwardly and across front of said jacket; the lower hemline of entire jacket is then folded upwardly toward the front of jacket and to the shoulder seams thus bringing the mating halves of the zipper tracks, attached to the back, together for zipping into the form of a backpack, c. with carrying pockets provided within the folded jacket by the spaces created between the folded lower half of jacket and upper front half of jacket with opening across the top, d. and the two parallel straps, described in claim 1 (e) become adjustable carrying straps to be worn over the shoulders in the fashion of a normal backpack.

* * * * *